United States Patent [19]

Kawamura

[11] 4,389,186

[45] Jun. 21, 1983

[54] COMBUSTION APPARATUS

[75] Inventor: Yoshio Kawamura, Yatabemachi, Japan

[73] Assignee: Agency for Industrial Science & Technology, Ministry of International Trade & Industry, Tokyo, Japan

[21] Appl. No.: 240,194

[22] Filed: Mar. 3, 1981

[51] Int. Cl.[3] ..... F23G 5/32

[52] U.S. Cl. ..... 431/173; 431/285

[58] Field of Search ..... 431/173, 10, 351, 352, 431/285

[56] References Cited

U.S. PATENT DOCUMENTS

| | | | |
|---|---|---|---|
| 2,967,224 | 1/1961 | Irwin | 431/285 |
| 3,052,287 | 9/1962 | Shirley | 431/10 X |
| 4,012,904 | 3/1977 | Nogle | 431/352 X |
| 4,144,017 | 3/1979 | Barsin et al. | 431/351 X |

*Primary Examiner*—Edward G. Favors

*Attorney, Agent, or Firm*—Kurt Kelman

[57] ABSTRACT

A combustion apparatus is disclosed wherein a main combustion chamber is provided at one end thereof with an auxiliary combustion chamber adapted for the combustion gas produced therein to flow spirally into the main combustion chamber, air is supplied to the auxiliary combustion chamber in an amount approximating the theoretical value based on the amount of the fuel supplied so as to ensure complete combustion in the auxiliary chamber, the fuel supplied into the main combustion chamber is mixed with the combustion gas coming from the auxiliary combustion chamber so that the resultant mixture, on combustion, produces a reducing atmosphere and this atmosphere is forwarded in the direction of the downstream side of the main combustion chamber, and the reducing combustion gas is completely burned by air introduced on the downstream side.

3 Claims, 5 Drawing Figures

COMBUSTION APPARATUS

BACKGROUND OF THE INVENTION

This invention relates to a combustion apparatus wherein the formation of nitrogen oxides (hereinafter referred to as $NO_x$) and the occurrence of combustion oscillation due to the combustion of a fuel are repressed.

As a measure to repress $NO_x$ formation, there has been known a two-stage combustion method which is based on a principle of burning, the fuel in a condition of deficient air supply to produce a reducing atmosphere. This two-stage combustion method represses the occurrence of $NO_x$ by either causing the $NO_x$ resulting from the combustion to be reduced into $N_2$ in a reducing atmosphere or burning the fuel in a reducing atmosphere thereby enabling the N component of the fuel to be decomposed into $N_2$ without being oxidized. To produce the reducing atmosphere in this two-stage combustion method, the air supply for the primary combustion is required to be maintained in a state of deficiency. When the air supply for the primary combustion is decreased below a certain level, there ensues oscillatory combustion.

This phenomenon can be presumed to occur because the supply of heat to the primary combustion zone is retarded due to the fact that when the air supply to this combustion zone is decreased the circulation of combustion gas is impaired and the velocity of reaction consequently lowered.

SUMMARY OF THE INVENTION

One object of this invention is to provide a multistage type combustion apparatus which represses the oscillatory combustion occuring when the formation of $NO_x$ due to the combustion of the fuel is reduced and the supply of air for the primary combustion decreased.

To accomplish the object described above according to this invention, there is provided a combustion apparatus which is provided at one end of its main combustion chamber with a fuel supply inlet, on the lateral wall of the main combustion chamber with an auxiliary combustion chamber for causing spiral flow of the combustion gas into the main combustion chamber and on the lateral wall of the main combustion chamber at a point downstream from the auxiliary combustion chamber with an air supply inlet.

In the combustion apparatus of this invention, as described above, the auxiliary combustion chamber which is provided in addition to the main combustion chamber serves the purpose of retaining the primary fuel in a stable state of combustion and of supplying heat to help maintain the combustion within the main combustion chamber. On the other hand, the amount of air present in the main combustion chamber is not sufficient for complete combustion of the fuel supplied thereto so that the combustion gas within the main chamber consitutes a strongly reducing atmosphere which reduces $NO_x$ within the combustion gas to $N_2$, whereafter the combustion gas is completely burned by the air introduced on the downstream side of the main combustion chamber.

The other objects and characteristics of the present invention will become apparent from the further disclosure of the invention to be made hereinbelow with reference to the accompanying drawings.

DESCRIPTION OF THE PREFERRED EMBODIMENT

Figure 1:
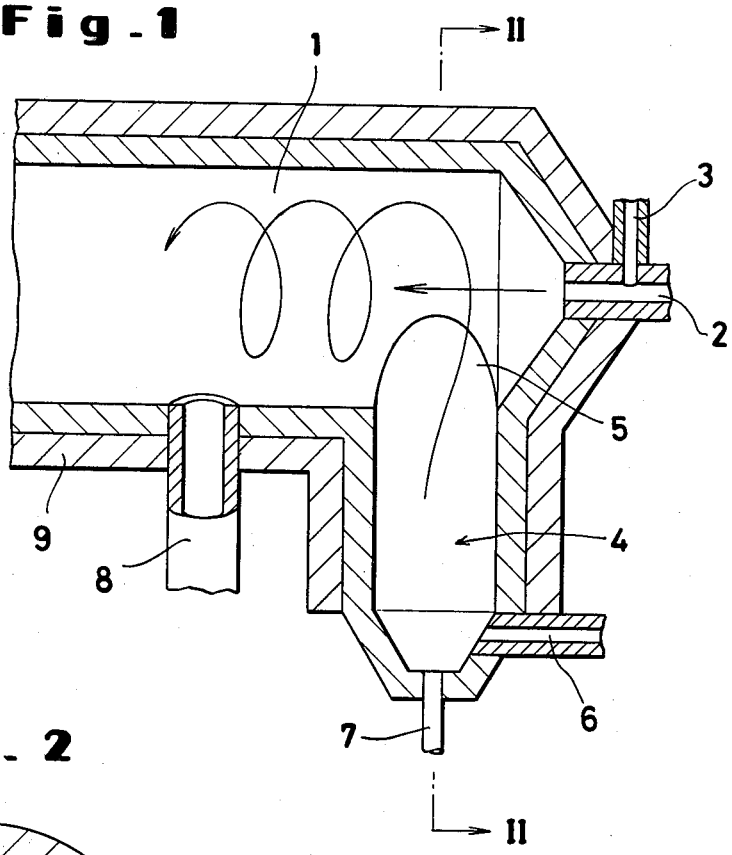
FIG. 1 is a schematic sectioned view of the burner unit of the combustion apparatus according to the present invention.

FIG. 1 illustrates the burner unit of the combustion apparatus provided by the present invention. A main combustion chamber 1 is provided at one end thereof with a fuel supply inlet 2 and an air supply inlet 3. At the position at which the fuel is injected by the fuel supply inlet 2, the lateral wall of the main combustion chamber is confronted by an opening 5 of an auxiliary combustion chamber 4. The auxiliary combustion chamber 4 is provided at one end thereof with a fuel supply inlet 7 and an air supply inlet 6.

Figure 2:
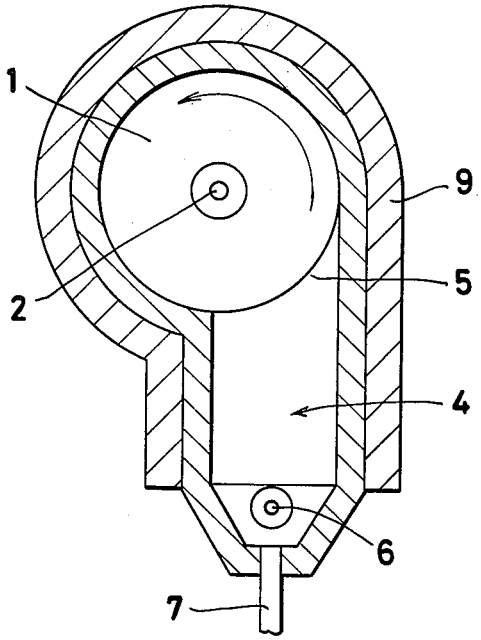
FIG. 2 is a sectioned view of the burner unit taken along the line II—II of FIG. 1.

The auxiliary combustion chamber is eccentrically joined to the main combustion chamber as illustrated in FIG. 2 so that the combustion gas occurring within the auxiliary combustion chamber 4 is caused to enter the main combustion chamber perpendicularly to the direction of the fuel from the fuel supply inlet 2 and flow spirally on the lateral wall of the main combustion chamber. The main combustion chamber 1 is provided on the lateral wall thereof at a point further downstream from the opening 5 of the auxiliary combustion chamber with an air supply inlet 8, and its other end is connected to a boiler (not shown). Although the air supply inlet 8 is illustrated in the drawing as one simple nozzle, it is actually adapted so as to distribute the incoming air evenly through the lateral wall of the main combustion chamber. Optionally, this burner may be covered with a cooling jacket 9.

In the combustion apparatus constructed as described above, the fuel is injected through the fuel supply inlet 7 and air is supplied through the air supply inlet 6 to start combustion within the auxiliary combustion chamber 4. The amount of fuel which is injected through the fuel supply inlet 7 is within the range of from 60 to 90% of the total of the fuel to be consumed by the combustion apparatus, and the amount of the air supplied through the air supply inlet 6 is approximately the theoretical amount of air required for combustion of the fuel to be supplied through the inlet 7.

When the fuel and the air are supplied in the proportions described above, the fuel undergoes substantially complete combustion within the auxiliary combustion chamber and the resultant combustion gas is delivered to the main combustion chamber 1. Because of the high temperature at which this combustion occurs, the combustion gas contains $NO_x$. When the $NO_x$ content of the combustion gas is excessively high, the occurrence of this $NO_x$ is lowered by cooling the auxiliary combustion chamber by means of the cooling jacket 9 or decreasing the amount of air being supplied.

The combustion gas from the auxiliary combustion chamber flows spirally along the side wall of the main combustion chamber in the downstream direction of the main combustion chamber. The fuel injected through the fuel supply inlet 2 of the main combustion chamber is ignited on being mixed with the hot combustion gas from the auxiliary combustion chamber 7 which is spirally flowing about the column of injected fuel. To ensure more uniform mixture of the spirally flowing combustion gas from the auxiliary combustion chamber with the fuel from the fuel supply inlet 2, the opening 5 of the auxiliary combustion chamber is joined with the main combustion chamber in such a manner as to transverse the center of the main combustion chamber as illustrated in FIG. 2. By thus changing the direction of the injected fuel from the main combustion chamber by means of the combustion gas, the injected fuel mixes with the combustion gas and burns.

The fuel which is injected through the fuel supply inlet 2 is equal to the total amount of fuel required for the entire combustion apparatus minus the amount supplied to the auxiliary combustion chamber, and it generally falls within the range of from 10 to 40% of the total. Through the air supply inlet 3 in the main combustion chamber, very little air is supplied for the purpose of burning the fuel. Consequently, the fuel introduced through the fuel supply inlet 2 is burned by the oxygen remaining i the combustion gas from the auxiliary combustion chamber. The mixture of the fuel and the combustion gas spirally flowing inside the main combustion chamber, therefore, constitutes a strongly reducing atmosphere and the $NO_x$ contained in the combustion gas is reduced to $N_2$. Thus, the combustion gas flowing in the downstream direction contains $N_2$ instead of $NO_x$. If the fuel of the main combustion chamber is heavily deficient in oxygen supply, it may undergo incomplete combustion and produce notable carbon deposition on the wall of the combustion chamber. To preclude this carbon deposition, the minimum amount of air required for this purpose is introduced through the air supply inlet 3.

The main combustion chamber is provided on the downstream side thereof with an air supply inlet 8 which serves the purpose of supplying the amount of air required for complete combustion of the combustion gas having the combustion gas from the auxiliary combustion chamber reduced by the fuel coming through the fuel supply inlet 2. The spirally flowing mixed combustion gas consequently undergoes complete combustion while continuing on its course toward the boiler (not shown). If the air supplied through the air supply inlet 8 burns the spirally flowing gas at a high temperature such as to increase notably the $NO_x$ content of the resulting combustion gas, the occurrence of the $NO_x$ is curbed by lowering the temperature of the main combustion chamber by means of the cooling jacket 9.

Figure 3:
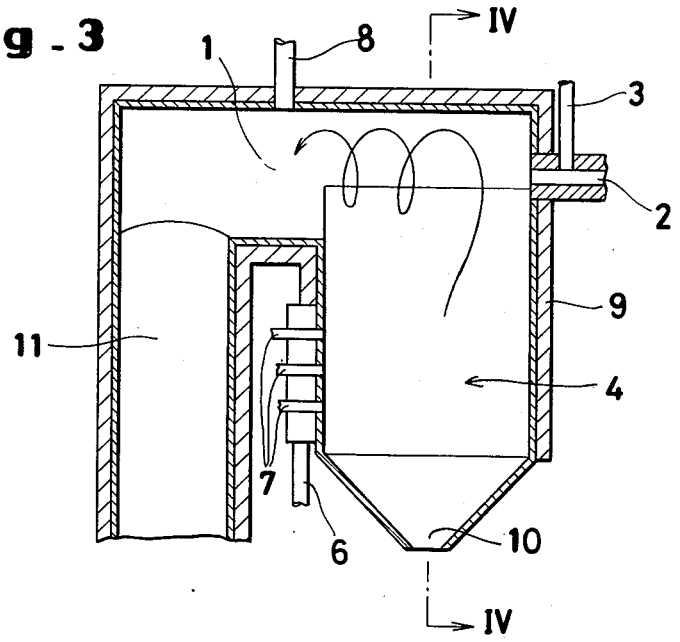
FIG. 3 is a schematic sectioned view of another embodiment of the combustion apparatus according to the present invention.
Figure 4:
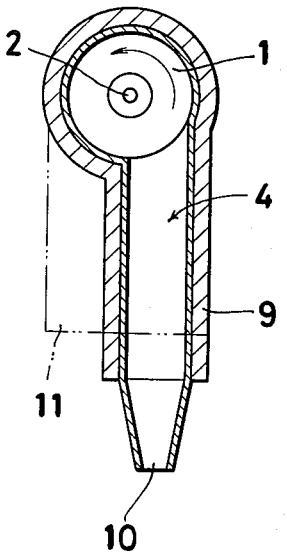
FIG. 4 is a sectioned view of the combustion apparatus taken along the line IV—IV of FIG. 3.

FIG. 3 represents a combustion apparatus contemplated by this invention for use with a boiler. The auxiliary combustion chamber 4 is provided with a plurality of fuel supply inlets 7, through which a solid fuel such as finely divided coal is supplied into the auxiliary combustion chamber. Naturally, these inlets can be adapted to supply a liquid fuel such as heavy oil instead of the solid fuel.

The pulverized coal supplied into the auxiliary combustion chamber is stably burned by the air delivered through the air supply inlet 6 in an amount equal to the theoretical value required for combustion of the fuel, and the resulting combustion gas is forwarded to the main combustion chamber 1. The residue of the burned solid fuel is continually discharged through the outlet 10. The combustion gas forwarded to the main combustion chamber flows spirally along the wall, engulfs the fuel supplied through the secondary fuel supply inlet 2 and continues its course toward the main combustion chamber while undergoing combustion. In this case, the ratio of the amounts of fuel supplied through the fuel supply inlets 2 and 7 is within the range of from 4:6 to 1:9. Normally, no air is supplied through the air supply inlet 3. The spirally flowing combustion gas within the main combustion chamber 1, therefore, constitutes a reducing atmosphere, with the result that the $NO_x$ present in the flowing gas is reduced to $N_2$. By the air supplied through the air supply inlet 8 disposed on the downstream side of the main combustion chamber, the spirally flowing combustion gas of a reducing nature is completely burned and forwarded to the boiler 11.

If the combustion temperature within the auxiliary combustion chamber or the main combustion chamber is so high as to induce heavy occurrence of $NO_x$, the wall of the combustion chamber is suitably cooled by means of the cooling jacket 9 to eliminate the occurrence of $NO_x$.

As described above, this invention permits stable combustion of the primary fuel within the auxiliary combustion chamber by increasing the ratio of the amount of the fuel introduced through the fuel supply inlet 7 to that of the fuel supplied from the fuel supply inlet 2, enables the resultant combustion gas to constitute a reducing atmosphere by uniformly mixing the combustion gas with the fuel and allowing the mixture to burn in a condition deficient in oxygen supply, consequently causes the $NO_x$ present in the gas to be reduced to $N_2$, and ensures complete combustion of the resultant combustion gas by additional supply of air. Thus, this invention precludes the unstable combustion which often occurs in two-stage combustion, provides more effective repression of $NO_x$ occurrence and assures complete combustion.

EXAMPLE

Figure 5:
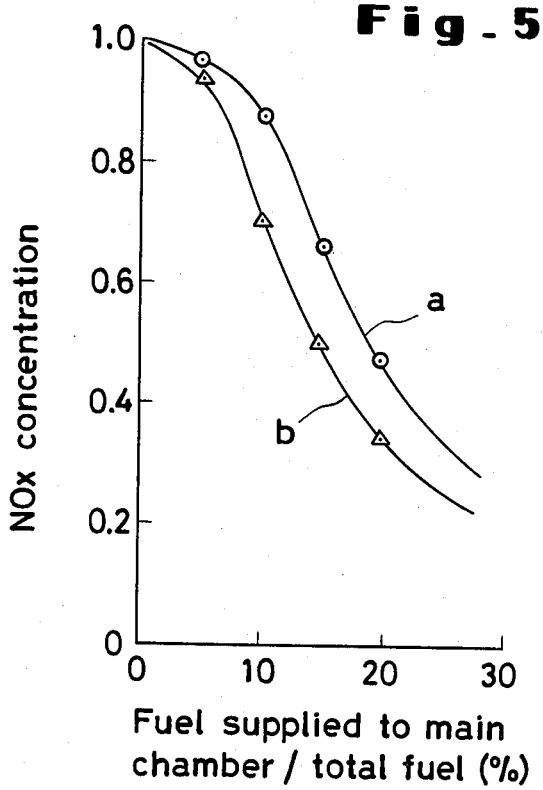
FIG. 5 is a graph showing the relation between the amount of the secondary air and the $NO_x$ concentration in the combustion performed by use of the combustion apparatus of the present invention.

In a combustion apparatus constructed as illustrated in FIG. 1 by using an auxiliary combustion chamber 180 mm in inside diameter and 500 mm in length and a main combustion chamber 280 mm in inside diameter and 700 mm in length and incorporating an air supply inlet at a distance of 700 mm from the upstream end of the main combustion chamber, a fuel prepared by adding pyridine to kerosene so as to adjust the N content to 0.2% was spray injected through the fuel supply inlet into the auxiliary combustion chamber at a rate of 15 liters/hr, with the feeding amount of the same fuel from the fuel supply inlet of the main combustion chamber varied. The combustion gas en route to the exhaust duct was analyzed for $NO_x$ concentration. The results are shown in FIG. 5. In this graph, the vertical axis represents the $NO_x$ concentration in the exhaust duct, with the concentration at the time no fuel is supplied through the fuel supply inlet of the main chamber being defined as 1.0 and the horizontal axis represents the proportion of the amount of the fuel supplied through the fuel supply inlet in the main combustion chamber relative to the total amount of fuel supplied to both the auxiliary combustion chamber and the main combustion chamber. The amounts of air supplied through the air supply inlets were adjusted so that in the test run corresponding to the curve "a" of the graph, the oxygen concentration in the exhaust gas was 2.0% and the air ratio of the combustion gas at the outlet of the auxiliary combustion chamber was 1.05 and, in the test run corresponding to the curve "b", the magnitudes were 0.5% and 0.97 respectively. As is clear from this graph, the amount of $NO_x$ produced decreased to about 70% when the amount of the fuel supplied to the main combustion chamber was fixed at about 1.67 liters/hr (10%), and the $NO_x$ concentration in the exhaust gas obtained by increasing the amount of the fuel to about 6 liters/hr (about 28.6%) decreased by about one fifth as compared with the level obtained in the absence of the combustion of the fuel supplied to the main combustion chamber.

What is claimed is:

1. A combustion apparatus comprising a main combustion chamber, a secondary fuel supply means for supplying into the main combustion chamber 10 to 40% of all the fuel to be supplied, an auxiliary combustion chamber disposed in the lateral wall of the main combustion chamber to permit combustion gas to flow to the position at which the fuel for the main combustion chamber is supplied, a first fuel supply means for supplying 60 to 90% of all the fuel to be supplied into the auxiliary combustion chamber, a first air supply means for supplying air in an amount equal to the amount theoretically required for combustion of the fuel supplied into the auxiliary combustion chamber, and a second air supply means disposed on the lateral wall of the main combustion chamber at a position downstream of the position at which the combustion gas from the auxiliary combustion chamber is supplied.

2. The combustion apparatus according to claim 1, wherein the air supplied by the second air supply means is in an amount necessary for complete combustion of a mixture of the fuel supplied by the secondary fuel supply means and the combustion gas.

3. The combustion apparatus according to claim 1, wherein the auxiliary combustion chamber is disposed so that the combustion gas produced therein mixes with the fuel supplied through the secondary fuel supply means and the resultant mixture spirally flows along the lateral wall of the main combustion chamber.

* * * * *